US005616412A

United States Patent [19]

Lin

[11] Patent Number: 5,616,412

[45] Date of Patent: Apr. 1, 1997

[54] PROCESS FOR PREPARING LOW DENIER FILAMENTS WITH HIGH ELONGATION AND THOSE FILAMENTS

[75] Inventor: Perry H. Lin, Hixson, Tenn.

[73] Assignee: E. I. Du Pont de Nemours and Company, Wilmington, Del.

[21] Appl. No.: 661,510

[22] Filed: Jun. 11, 1996

[51] Int. Cl.[6] ..... D07G 3/00

[52] U.S. Cl. ..... 428/373; 428/374; 525/240; 525/241

[58] Field of Search ..... 428/373, 374; 525/240, 241

[56] References Cited

U.S. PATENT DOCUMENTS 5,116,681 5/1992 Lin ..... 428/373

*Primary Examiner*—Newton Edwards

[57] ABSTRACT

Fine denier filaments having a high elongation at break of a blend polypropylene and polystyrene are made by forming an intimate blend using a twin screw extruder and then spinning the blend.

1 Claim, No Drawings

PROCESS FOR PREPARING LOW DENIER FILAMENTS WITH HIGH ELONGATION AND THOSE FILAMENTS

This application claims the benefit of U.S. Provisional application Ser. No. 60/000,445, filed Jun. 22, 1995, now abandoned.

FIELD OF THE INVENTION

This invention relates to a process for preparing low denier filaments of a blend of polypropylene and polystyrene that have a high elongation at break.

BACKGROUND OF THE INVENTION

Lin U.S. Pat. No. 5,116,681 discloses fibers made from blends of polypropylene and polystyrene. Example 2E of Lin shows an elongation of 449% when the fiber contains 2% polystyrene, and no conductive carbon black. Example 4 of Lin shows an elongation of 497% when the fiber contains 2% polystyrene and has a conductive core.

It has now been discovered that the elongation at break for filaments made from a blend of polypropylene and polystyrene can be controlled in such a manner that fine denier filaments have elongations at break exceeding 700%.

SUMMARY OF THE INVENTION

This invention is a process for the production of fine denier filaments of a blend of polypropylene and polystyrene which comprises blending polypropylene having a melt flow index of 15 to 25 dgrams per minute (measured by ASTM-D-1238) with 2 to 10% by weight amorphous polystyrene having a melt flow index of 1 to 20 dgrams per minute (measured by ASTM-D-1238 condition G) with a twin screw extruder to form an intimate blend having fine particles of polystyrene dispersed in the polypropylene, and then extruding the blend at a rate of 900 to 1500 meters per minute through a capillary having a length over diameter ratio of 2 to 10, to yield filaments with a denier of 2 to 4 while quenching the filaments.

In a preferred embodiment the polypropylene has a melt flow index of 20 dgrams per minute, the amorphous polystyrene a melt flow index of 1.5, the spinning speed is between 900 and 1200 meters per minute, the capillary length to diameter ratio is 4.7, and the amount of polystyrene is 3 to 6% by weight of the blend.

This invention is also the filament product of the aforementioned process—filaments of an intimate blend of 90 to 98 weight percent polypropylene having a melt flow index of 15 to 25 dgrams per minute and 2 to 10 weight percent amorphous polystyrene, having a melt flow index of 1 to 20 dgrams per minute, wherein the filaments have a denier of 2 to 4 and an elongation of greater than 700%.

DETAILED DESCRIPTION

The process of the invention is carried out in the manner set forth in Lin, U.S. Pat. No. 5,116,681, with the variations noted above. The Lin Patent is incorporated herein by reference.

The intimate blend of small polystyrene particles in polypropylene may be achieved by coextruding a flake blend of the two polymers with a twin screw extruder. Alternatively, the blend may be obtained by first forming a masterbatch of polypropylene and polystyrene containing somewhat more polystyrene than desired in the fiber, and then a portion of the masterbatch is combined with additional polypropylene in a twin screw extruder to obtain the desired polystyrene concentration in the product. "Dispersive mixing," which is needed to achieve the desired product, cannot be achieved with a single screw extruder.

EXAMPLE

Polystyrene having an average molecular weight of 280,000 and a melt flow index of 1.5 (sold by the Mobil Chemical Company, bearing the trade designation "PS 1800") was blended with polypropylene having a melt flow index of 20 (sold by the Shell Oil Company) in amounts of 3 and 6 weight percent polystyrene, based on the weight of the blend. Polypropylene with no polystyrene was used as a control.

The polymer blends and the control were melted in a 28 mm twin screw extruder and were fed to a pack filter at a temperature of about 250 degrees C. Filaments were obtained by extruding the molten polymer materials from a spinneret with 34 round cross-section capillaries having an L/D ratio of 4.7. The extruded filaments were passed through a chamber 60 inches long where they were cross-flow quenched with room temperature air. The filaments were extruded at a feed roll speed (rate) of 1200 meter per minute; and the resulting denier per filament was about 3. Filament elongation results summarized below show that addition of polystyrene to polypropylene under the conditions described significantly increases the elongation.

| % Polystyrene Added | % Elongation |
|---|---|
| 0 | 581 (control) |
| 3 | 707 |
| 6 | 738 |

What is claimed is:

1. A filament comprising an intimate blend of 90 to 98 weight percent polypropylene having a melt flow index of 15 to 25 dgrams per minute and 2 to 10 weight percent polystyrene having a melt flow index of 1 to 20 dgrams per minute wherein the filament has a denier of 2 to 4 and an elongation of greater than 700%.

* * * * *